US009611621B2

(12) United States Patent
Zwanenburg et al.

(10) Patent No.: US 9,611,621 B2
(45) Date of Patent: Apr. 4, 2017

(54) CUTTING DREDGER

(71) Applicant: IHC HOLLAND IE B.V., Sliedrecht (NL)

(72) Inventors: Meindert Zwanenburg, Gouda (NL); Stephan David Arjan Hannot, Delft (NL); Vincent Leonard Toet, Dordrecht (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 14/654,091

(22) PCT Filed: Dec. 19, 2013

(86) PCT No.: PCT/NL2013/050920

§ 371 (c)(1),
(2) Date: Jun. 19, 2015

(87) PCT Pub. No.: WO2014/098590

PCT Pub. Date: Jun. 26, 2014

(65) Prior Publication Data

US 2015/0345107 A1 Dec. 3, 2015

(30) Foreign Application Priority Data

Dec. 20, 2012 (NL) ..... 2010028

(51) Int. Cl.
*E02F 3/92* (2006.01)
*E02F 3/88* (2006.01)
(Continued)

(52) U.S. Cl.
CPC ..... *E02F 3/8841* (2013.01); *E02F 3/905* (2013.01); *E02F 3/907* (2013.01); *E02F 3/9231* (2013.01); *E02F 5/28* (2013.01); *E02F 9/067* (2013.01)

(58) Field of Classification Search
CPC ..... E02F 3/9231; E02F 3/905; E02F 3/9237; E02F 3/9293; E02F 3/241; E02F 3/9212;
(Continued)

(56) References Cited

U.S. PATENT DOCUMENTS 2,850,814 A 9/1958 Ellicott, Jr.
2,963,801 A 12/1960 Ellicott, Jr.
(Continued)

FOREIGN PATENT DOCUMENTS

AU 2010201474 4/2010
DE 1981281 3/1968
(Continued)

OTHER PUBLICATIONS

International Search Report PCT/NL2013/050920 dated Mar. 28, 2014.

*Primary Examiner* — Robert Pezzuto
(74) *Attorney, Agent, or Firm* — NLO; Catherine A. Schultz; Minerva Rivero

(57) ABSTRACT

A method for operating a cutting dredger in open water, in particular to control a ground reaction force during dredging operations, the dredger including;

a floating body, an elongate cutter ladder having a cutting head at its lowerable free end for dredging, which cutter ladder is hingeably coupled to the floating body and hingeable between an upwards position and a cutting position wherein the cutting head engages matter to be cut away at the floor of a body of water.

22 Claims, 4 Drawing Sheets

(51) Int. Cl.
*E02F 5/28* (2006.01)
*E02F 3/90* (2006.01)
*E02F 9/06* (2006.01)

(58) Field of Classification Search
CPC ... E02F 9/067; E02F 9/062; E02F 5/28; E02F 3/907; E02F 3/8841
USPC ..... 37/309, 310, 327, 329, 334
See application file for complete search history.

(56) References Cited

U.S. PATENT DOCUMENTS

| | | | | | |
|---|---|---|---|---|---|
| 3,224,121 | A | | 12/1965 | Denning | |
| 3,470,633 | A | | 10/1969 | Soehnlen | |
| 3,739,503 | A | * | 6/1973 | Barker | E02F 3/905 254/275 |
| 3,777,376 | A | * | 12/1973 | Turner | E02F 3/9231 37/309 |
| 3,797,139 | A | * | 3/1974 | Larralde | E02F 9/067 37/310 |
| 3,959,897 | A | * | 6/1976 | May | E02F 3/405 241/101.71 |
| 4,095,545 | A | | 6/1978 | Vaughn et al. | |
| 4,102,064 | A | * | 7/1978 | Pot | E02F 3/9231 37/310 |
| 4,261,117 | A | | 4/1981 | Van der Peyl | |
| 4,267,652 | A | | 5/1981 | Senesac | |
| 4,373,277 | A | * | 2/1983 | Cucheran | E02F 3/9293 37/327 |
| 4,628,623 | A | | 12/1986 | Deal | |
| 4,819,346 | A | | 4/1989 | Maitlen | |
| 6,318,005 | B1 | | 11/2001 | Andre | |
| D740,331 | S | * | 10/2015 | Mikkola | D15/10 |
| 2005/0268499 | A1 | | 12/2005 | Weinrib et al. | |
| 2006/0027505 | A1 | | 2/2006 | Hayes et al. | |
| 2008/0172911 | A1 | | 7/2008 | Buhr et al. | |

FOREIGN PATENT DOCUMENTS

| | | |
|---|---|---|
| DE | 1912311 | 12/1969 |
| DE | 8629189 | 5/1987 |
| EP | 0928848 | 7/1999 |
| FR | 1594265 | 6/1970 |
| FR | 2087460 | 12/1971 |
| JP | 62029630 | 2/1987 |
| NL | 7513782 | 8/1976 |

* cited by examiner

CUTTING DREDGER

BACKGROUND

The present invention relates to a method for operating a cutting dredger in open water, in particular to control of a ground reaction force during dredging operations, the dredger comprising;

a floating body, an elongate cutter ladder having a cutting head at its lowerable free end for dredging, which cutter ladder is hingeably coupled to the floating body and hingeable between an upwards position and a cutting position wherein the cutting head engages matter to be cut away at the floor of a body of water, Such a method is known from US2005268499 which relates to method and apparatus for pumping with a dredge. Herein it is disclosed to apply a predetermined amount of load force by the head against the bottom. Herein, a winch and cable and the controller are operated to lift some of the head weight until the desired predetermined head force is applied to the bottom. It is a disadvantage that head weight can only be lifted.

In general, it is known to raise and lower a ladder connected to the hull of a dredger by a hydraulic cylinder like for instance in U.S. Pat. Nos. 3,470,633, 4,095,545A, 4,628,623A and 2,850,814. Typically, these dredgers have a relative short ladder and are not suitable to operate in open water and instead intend to operate in areas where room is restricted and/or areas with no or very small waves, like in a port or harbour. These hydraulic cylinders are not operated while dredging. It is however known to operate a ram cylinder to provide crowding action for tough digging. This ram cylinder is coupled with a relative short ladder not suitable for open water. Open water here means water with possibly significant wave height.

It is also known, like in U.S. Pat. No. 2,963,801A, to hydraulically drive a cutter ladder during swing motion, which is a lateral motion with respect to vertical motion.

US 2005/0268499 A relates to an environmental dredging method having a suction head for removing a contaminated layer from a bottom of a body of water. A predetermined amount of load force may be applied by the suction head against the bottom. Herein, a winch and cable and the controller are operated to lift some of the suction head weight until the desired predetermined head force is applied to the bottom. Such a suction head suspended from a cable does not suffice for controlling a ground reaction force of a cutting dredger.

U.S. Pat. No. 3,777,376 (A) discloses a dredging apparatus for use in heavy seas having a barge and an articulated ladder. U.S. Pat. No. 3,777,376 relates to positioning of ladder parts in that a lower ladder part is angularly movable relative to the upper ladder part, and means are provided for adjustably positioning said first ladder part at a selected angle relative to said barge. The ladder is moved between its working and non-working positions by a winch carrying a cable 87. Such a cable does not suffice for controlling a ground reaction force of a cutting dredger.

SUMMARY OF THE INVENTION

The invention aims to provide an improved control of the ground reaction force during dredging operations.

Another object of the invention is to improve known methods to control the ground reaction force during dredging operations in that a problem associated with that method is at least partly solved.

Yet another object of the invention is to provide an alternative method to control the ground reaction force during dredging operations and/or to keep a cutting head at a constant dredging depth independent of wave and soil conditions.

According to a first aspect of the invention this is realized with a method for operating a cutting dredger, the dredger comprising;

a floating body, an elongate cutter ladder having a cutting head at its lowerable free end for dredging, which cutter ladder is hingeably coupled to the floating body and hingeable between an upwards position and a cutting position wherein the cutting head engages matter to be cut away at the floor of a body of water, a driving device comprising an onboard hydraulic cylinder (8) coupled with the cutter ladder for hinging the cutter ladder between the upwards position and the cutting position, the method comprising the step;

operating the driving device, when the cutter ladder is in the cutting position, in order to urge the cutter ladder down in a controlled manner for controlling a ground reaction force F between the cutting ladder and the bottom of the body of water. for controlling the dredging process, in an embodiment operating the driving device, when the cutter ladder is in the cutting position, for controlling a ground reaction force between the cutting ladder and the bottom of the body of water, or alternatively.

The operating of the driving device, when the cutter ladder is in the cutting position, enables to provide control of the ground reaction force. In addition, the driving device enables not only to lift the cutter ladder but also to urge the cutter ladder down in a controlled manner. In addition, cumbersome winch system can be omitted. This enhances safety on board because the amount of breakable cables at deck level is reduces. In addition, the omission of the winch system safes space at deck level and provides a better survey ability.

The ground reaction force is the force between the cutting head of the cutter ladder and the bottom of a body of water. The ground reaction force supports at least a part of the weight of the cutter ladder. The ground reaction force is not to be confused with cutting forces between the cutting head and the matter to be cut away.

In an embodiment, the driving device comprises a number of hydraulic cylinders like for example a pair of hydraulic cylinders.

In an embodiment, the driving device comprises hydraulic cylinders set in parallel.

In an embodiment, the method comprises operating the cutting dredger under swell conditions. Since the ground reaction force is much more controllable, the cutting dredger is much more suitable to operate under swell conditions, specifically relative heavy swell conditions up to a significant wave height Hs of e.g. 3 m. The method preferably comprises operating the dredger in hard soil conditions..

In an embodiment of the method according to the invention, the ground reaction force is between about zero and about twice the weight of the cutter ladder. This is a beneficial result of the driving device enabling not only to lift the cutter ladder but also to urge the cutter ladder down in a controlled manner. A known winch system only provides a ground reaction force between zero and one times the weight of the cutter ladder. Such cable systems which suspend a ladder are known from e.g. US 2005/0268499 A and U.S. Pat. No. 3,777,376 (A).

In an embodiment, the length of the cutter ladder is about tens of meters, specifically between 10 and 70 meters. The length of the cutter ladder is such that the cutting dredger may operate at sea and thus under swell conditions.

In an embodiment, the method according to the invention comprises operating the driving device, when the cutter ladder is in the cutting position, for maintaining the cutting head at a constant dredging depth.

The invention further relates to a cutting dredger for use in the method according to the invention. The cutting dredger comprises;

a floating body, an elongate cutter ladder having a cutting head at its lowerable free end for dredging, which cutter ladder is hingeably coupled to the floating body and hingeable between an upwards position and a cutting position wherein the cutting head engages matter to be cut away at the floor of a body of water, and a driving device comprising an onboard hydraulic cylinder (8) coupled with the cutter ladder for hinging the cutter ladder between the upwards position and the cutting position, and for urging the cutter ladder down in a controlled manner for controlling a ground reaction force F between the cutting ladder and the bottom of the body of water.

In an embodiment of the cutting dredger according to the invention, the driving device comprises means for pressurizing the hydraulic cylinder.

In an embodiment, the means for pressurizing the hydraulic cylinder comprise an accumulator coupled with the hydraulic cylinder for providing the ground reaction force. The accumulator controls in a passive way the ground reaction force in that it operates the hydraulic cylinder at a substantially constant pressure which pressure determines the ground reaction force.

In an embodiment, the driving device comprises a control valve operationally coupled with the means for pressurizing and the hydraulic cylinder for controlled pressurizing of the hydraulic cylinder. This results in an active control of the ground reaction force or alternatively or additionally the dredging depth independent of soil and wave conditions.

In an embodiment, the cutting dredger comprising a measuring device for measuring the ground reaction force.

In an embodiment, the cutting dredger comprises a display device operationally coupled with the measuring device for displaying the ground reaction force.

In an embodiment, the cutting dredger comprises a control unit operationally coupled with the measuring device and the hydraulic cylinder for controlling the ground reaction force. Preferably, for controlling the ground reaction force the control unit is operationally coupled with the hydraulic cylinder via the control valve.

In an embodiment, the control unit is operationally coupled with the measuring device and the hydraulic cylinder for controlling a dredging depth. The dredging depth is measured in a usual manner based on the angle a of the cutter ladder with respect to the floating body and the submersion of the floating body at the hinge point of the cutter ladder.

In an embodiment, the cutting dredger comprises an input device operationally coupled with the control unit for setting a desired ground reaction force.

In an embodiment, the measuring device comprises a pressure sensor operationally coupled with the hydraulic cylinder.

In an embodiment of the cutting dredger, the driving device is directly coupled with the cutter ladder. This provides a more direct control of the ground direction force.

In an embodiment of the cutting dredger, the hydraulic cylinder piston rod is directly coupled with the cutter ladder and a hydraulic cylinder barrel is coupled with the floating body. This ensures that a maximum driving force is available when moving the cutter ladder from the cutting position to the upwards position. This is all the more of importance when, as preferred, the cutter ladder in its upward position is at least partly above the water surface.

In an embodiment of the cutting dredger, a line of action of the hydraulic cylinder extends at between about 10° to about 50° with respect to the horizontal during moving of the cutter ladder between the upwards position and the cutting position. This ensures an optimal arm between the line of action and the hinge point of the cutter ladder during the entire movement of the cutter ladder between the upwards position and the cutting position and vice versa.

In an embodiment, the cutting dredger comprises a spud device for providing support to the cutting dredger during dredging operations. Such a spud device is well known per se.

In an embodiment of the cutting dredger, the length of the cutter ladder is about tens of meters, specifically between 10 and 70 meters.

The hydraulic cylinder is an onboard cylinder. This is beneficial in terms of environmental effects because the hydraulics is not in direct contact with the outboard water.

The invention further relates to a device comprising one or more of the characterising features described in the description and/or shown in the attached drawings.

The invention further relates to a method comprising one or more of the characterising features described in the description and/or shown in the attached drawings.

The various aspects discussed in this patent can be combined in order to provide additional advantageous advantages.

DESCRIPTION OF THE DRAWINGS

The invention will be further elucidated referring to an preferred embodiment shown in the schematic drawings wherein shown in.

DETAILED DESCRIPTION OF EMBODIMENTS

Figure 1:
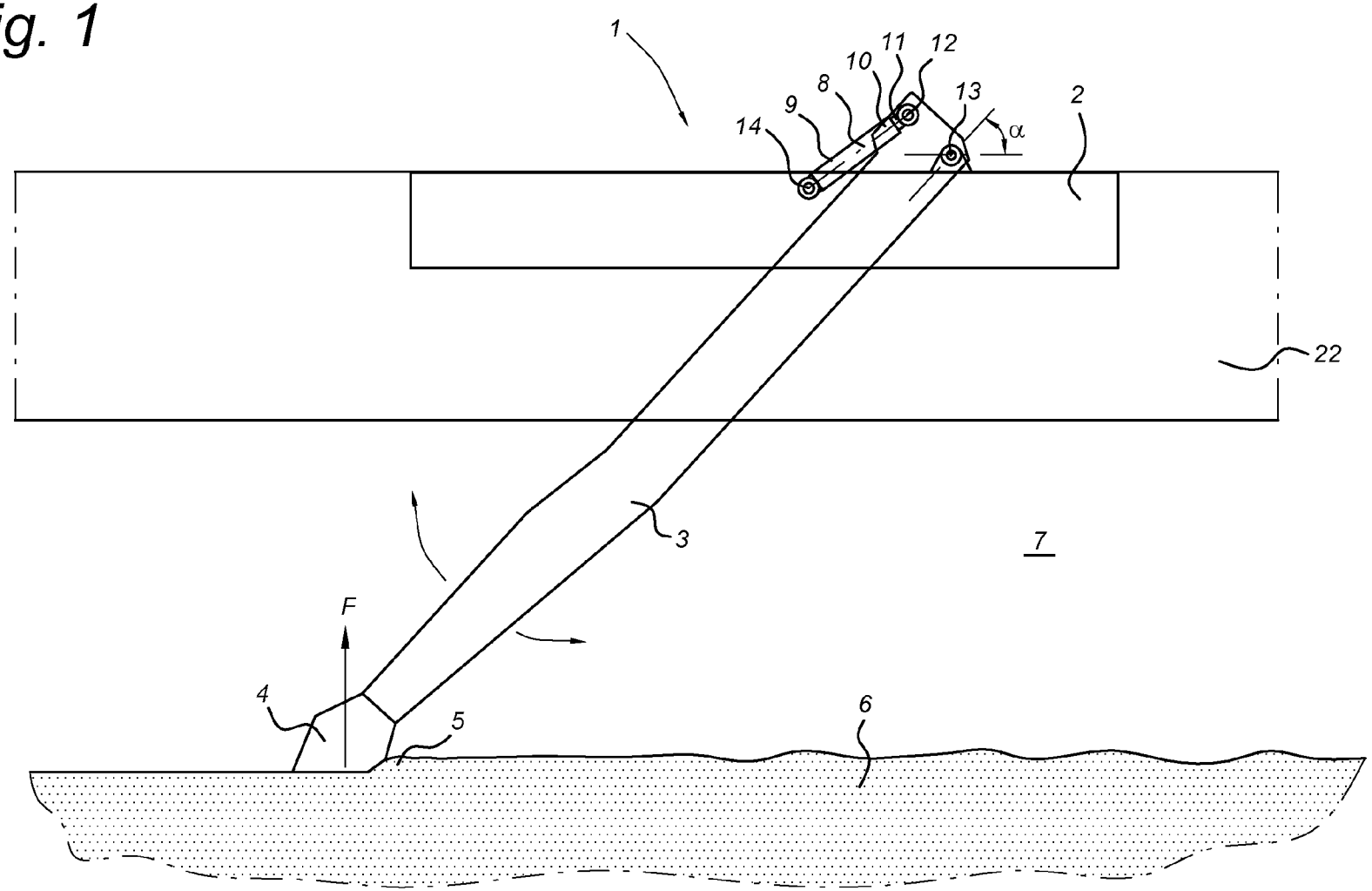
FIG. 1 in side view a cutting dredger with the cutter ladder in cutting position.
Figure 2:
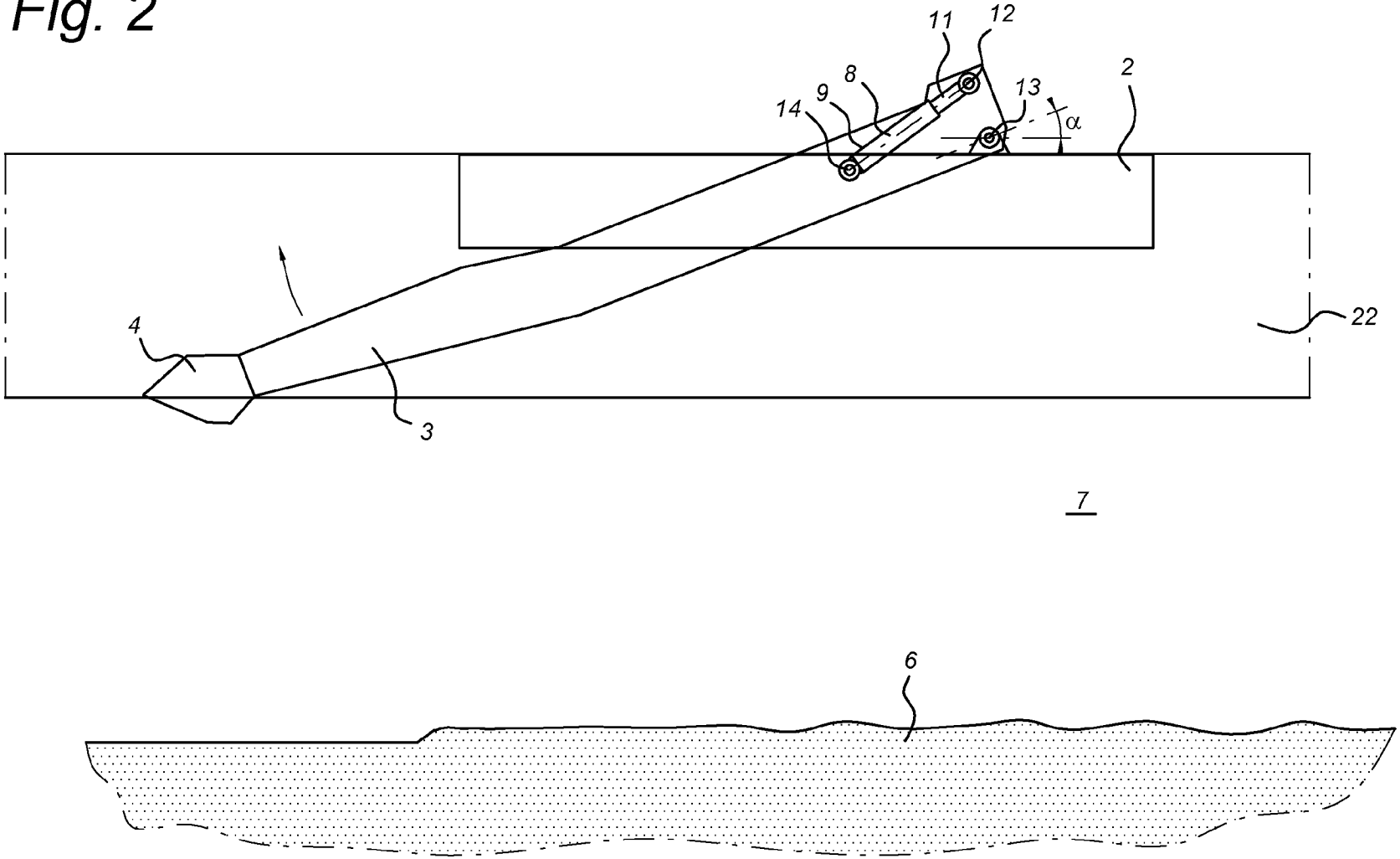
FIG. 2 the cutting dredger according to FIG. 1 with the cutter ladder in an intermediate position.
Figure 3:
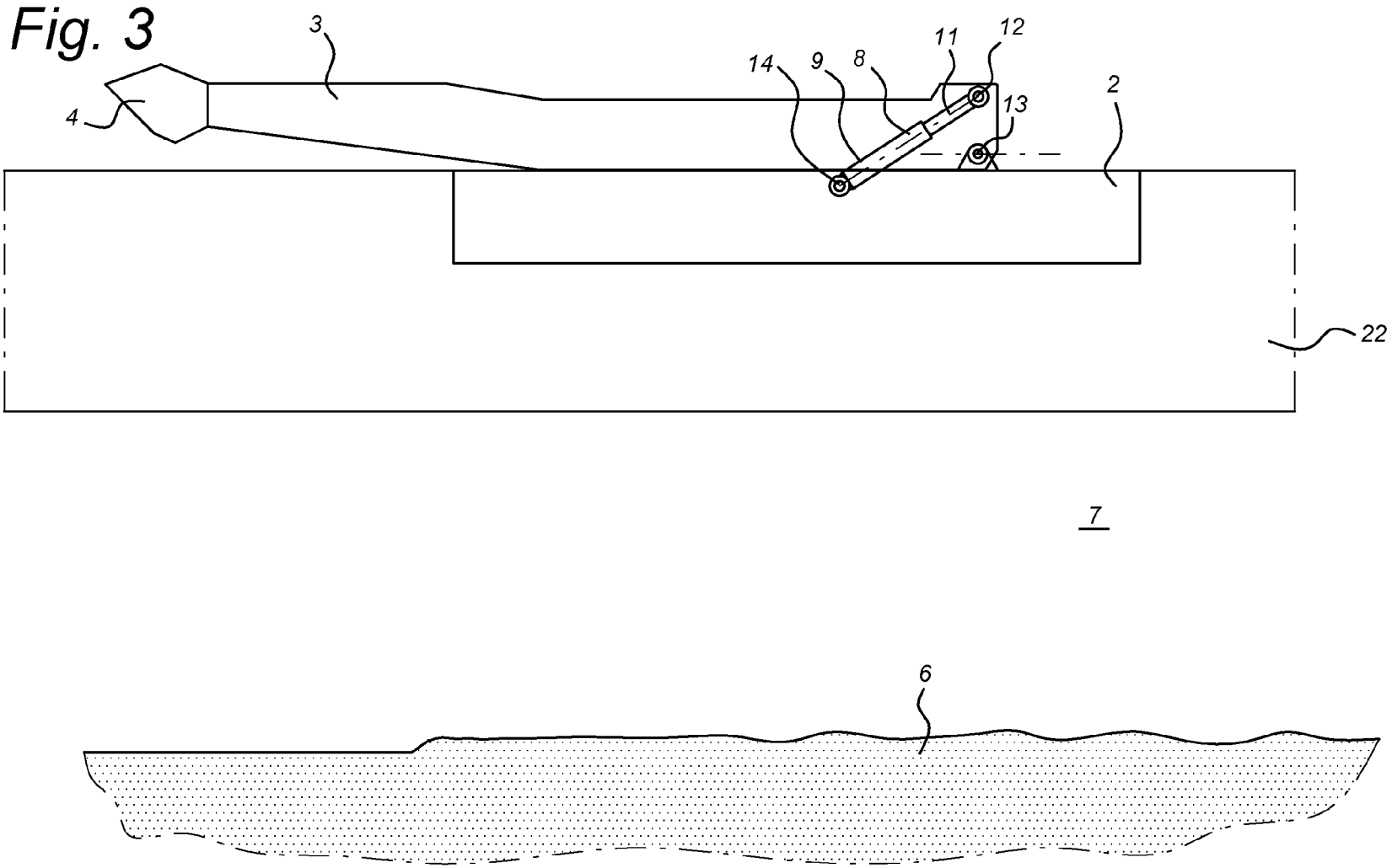
FIG. 3 the cutting dredger according to FIG. 1 with the cutter ladder in the upward position.

The invention will now be described in more detail referring to FIGS. 1-4. The cutting dredger 1 for use in the method according to the invention, comprises a floating body 2, like a hull etc. The cutting dredger 1 comprises an elongate cutter ladder 3 for reaching the floor 6 of a body of water 7. The length of the cutter ladder is about tens of meters, specifically between 10 and 70 meters for reaching the floor 6 of a body of water 7 like the sea. The cutter ladder 3 is hingeably coupled to the floating body 2. The cutter ladder 3 is hingeably coupled to the floating body 2 at a hinge point 13. The cutter ladder 3 is hingeable between an upwards position shown in FIG. 3 and a cutting position shown in FIG. 1. The elongate cutter ladder 3 has a cutting head 4 at its lowerable free end for dredging. When the cutter ladder 3 is in the cutting position, the cutting head 4 engages matter to be cut away at the floor 6 of a body of water 7. When the cutter ladder 3 is in the cutting position, the cutter ladder 3 is supported both by the floor 6 and the pivot point 13. The cutter ladder 3 support at the floor 6 is referred to a ground reaction force F. This ground reaction force plays an important role to be able to penetrate hard soils and as a result of this to be able to cut away this soil at the floor 6.

The cutting dredger 1 comprises a driving device for hinging the cutter ladder 3 between the upwards position and the cutting position. Here, the driving device comprises an hydraulic cylinder 8. Here, the hydraulic cylinder 8 is an onboard cylinder. It is conceivable to use a number of hydraulic cylinders, like for example a pair of parallel hydraulic cylinders on both sides of the cutter ladder 3. The hydraulic cylinder 8 is coupled with the cutter ladder 3 for hinging the cutter ladder 3 between the upwards position and the cutting position. Here, the hydraulic cylinder 8 is directly coupled with the cutter ladder 3 which improves controllability of the ground reaction Force F. The hydraulic cylinder piston rod 11 is directly coupled with the cutter ladder 3. The hydraulic cylinder piston rod 11 is hingeably coupled with the cutter ladder 3 by a piston rod hinge point 12. The hydraulic cylinder barrel 9 is coupled with the floating body 2 to provide a maximum driving force when the cutter ladder moves towards its upward position. The hydraulic cylinder barrel 9 is hingebly coupled with the floating body 2 by a barrel hinge point 14. Here, the line of action 10 of the hydraulic cylinder 8 extends at about 45° with respect to the horizontal during moving of the cutter ladder 3 between the upwards position and the cutting position. This ensures even more an optimal arm between the line of action and the hinge point of the cutter ladder during the entire movement of the cutter ladder between the upwards position and the cutting position and vice versa.

Figure 4:
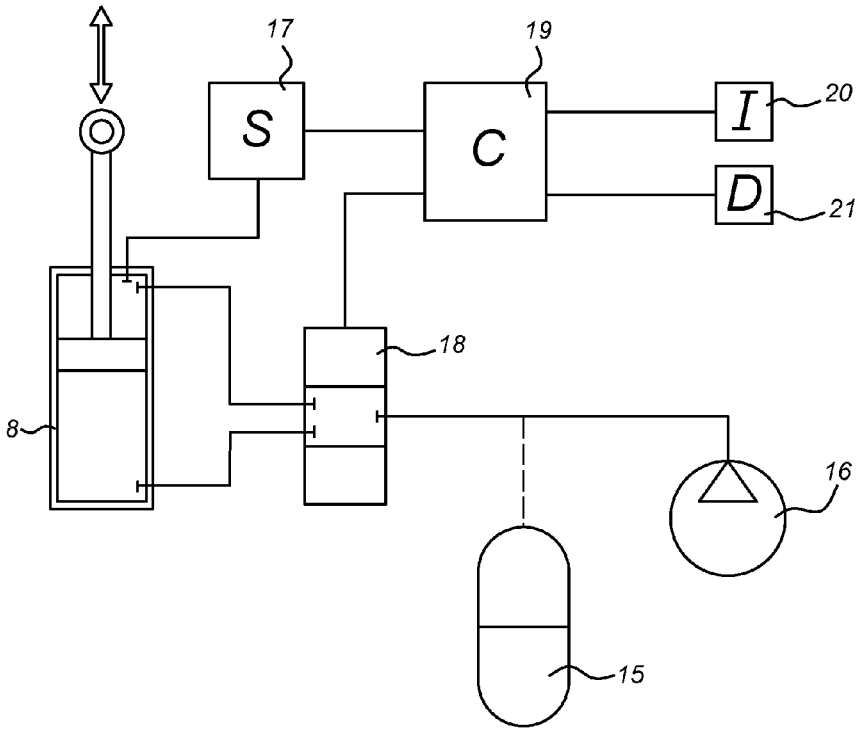
FIG. 4 a functional scheme of the driving device.

As shown in FIG. 4, the driving device comprises a hydraulic cylinder 8 as well as means 15, 16 for pressurizing the hydraulic cylinder. The means for pressurizing the hydraulic cylinder 8. Here, the means for pressurizing the hydraulic cylinder comprise an accumulator 15 coupled with the hydraulic cylinder 8 for providing a controlled ground reaction force F. In addition, here a hydraulic pump 16 is provided for driving the cutter ladder 3. The driving device comprises a control valve 18 operationally coupled with the means 15, 16 for pressuring the hydraulic cylinder and the hydraulic cylinder 8 for controlled pressurizing of the hydraulic cylinder 8.

The driving device comprises a measuring device 17 for measuring the ground reaction force. Here, the measuring device is a pressure sensor 17 operationally coupled with the hydraulic cylinder 8 for measuring the ground reaction force F.

The driving device comprises a control unit 19 operationally coupled with the measuring device 17 and the hydraulic cylinder 8 for controlling the ground reaction force. Here, the control unit 19 is operationally coupled with the hydraulic cylinder 8 via the control valve 18. The ground reaction force is continuously controlled. The control unit 19 may be operationally coupled with the measuring device 17 and the hydraulic cylinder 8 such the dredging depth or thickness of a cutaway layer may be controlled as well wherein the dredging depth is measured in a known manner.

The driving device here comprises a display device 21 operationally coupled with the measuring device 17 for displaying the actual ground reaction force to an operator. The display device 21 is operationally coupled with the measuring device 17 via the control unit 19.

The driving device here comprises an input device 20 operationally coupled with the control unit 19 for setting a desired ground reaction force by an operator.

In use of the schematically shown cutting dredger 1 the cutter ladder 3 is lowered towards its cutting position. Then the hydraulic cylinder 8 is operated such that the ground reaction force F between the cutting ladder 3 and the bottom 6 of the body of water 7 is controlled in a continuous manner. Here, the ground reaction force F is controlled between about zero and about twice the weight of the cutter ladder 3. The dredging may be performed under relative heavy swell conditions.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A method for operating a cutting dredger in open water, the dredger comprising a floating body, an elongate cutter ladder comprising a lower free end with a cutting head for dredging, and a hinge point, the elongate cutter ladder being hingeably coupled to the floating body at the hinge point and hingeable between an upwards position and a cutting position in which the cutting head engages matter to be cut away at a floor of a body of water, and a driving device comprising an onboard hydraulic cylinder directly coupled with the elongate cutter ladder at a positon near the hinge point for hinging the cutter ladder between the upwards position and the cutting position, the method comprising the step of operating the driving device, when the elongate cutter ladder is in the cutting position to urge the elongate cutter ladder down in a controlled manner for controlling a ground reaction force F between the elongate cutter ladder and the bottom of the body of water.

2. The method according to claim 1, wherein the driving device comprises a plurality of hydraulic cylinders.

3. The method according to claim 2, wherein the hydraulic cylinders are set in parallel.

4. The method according to claim 1, comprising operating the cutting dredger under swell conditions.

5. The method according to claim 1, wherein the ground reaction force is between about zero and about twice the weight of the cutter ladder.

6. The method according to claim 1, wherein the length of the cutter ladder is between 10 and 70 meters.

7. The method according to claim 1, comprising operating the driving device for maintaining to maintain the cutting head at a constant dredging depth.

8. A cutting dredger comprising:

a floating body, an elongate cutter ladder comprising a lower free end with a cutting head for dredging and a hinge point at which the elongate cutter ladder is hingeably coupled to the floating and hingeable between an upwards position and a cutting position wherein the cutting head engages matter to be cut away at a floor of a body of water, and a driving device comprising an onboard hydraulic cylinder directly coupled with the elongate cutter ladder at a positon near the hinge point for hinging the elongate cutter ladder between the upwards position and the cutting position, and for urging the elongate cutter ladder down in a controlled manner for controlling a ground reaction force F between the elongate cutter ladder and the floor of the body of water.

9. The cutting dredger according to claim 8, wherein the driving device further comprises means for pressurizing the hydraulic cylinder.

10. The cutting dredger according to claim 9, wherein the means for pressurizing the hydraulic cylinder comprises an accumulator coupled with the hydraulic cylinder for providing the ground reaction force.

11. The cutting dredger according to claim 9, wherein the driving device further comprises a control valve operationally coupled with the means for pressuring the hydraulic cylinder and the hydraulic cylinder to control the pressure of the hydraulic cylinder.

12. The cutting dredger according to claim 8, and further comprising a measuring device for measuring the ground reaction force.

13. The cutting dredger according to claim 12, and further comprising a display device operationally coupled with the measuring device for displaying the ground reaction force.

14. The cutting dredger according to claim 12, and further comprising a control unit operationally coupled with the measuring device and the hydraulic cylinder for controlling the ground reaction force.

15. The cutting dredger according to claim 14, wherein the control unit is operationally coupled with the measuring device and the hydraulic cylinder for controlling the dredging depth.

16. The cutting dredger according to claim 14, and further comprising an input device operationally coupled with the control unit for setting a desired ground reaction force.

17. The cutting dredger according to claim 12, wherein the measuring device comprises a pressure sensor operationally coupled with the hydraulic cylinder.

18. The cutting dredger according to claim 8, wherein a hydraulic cylinder piston rod is directly coupled with the cutter ladder and a hydraulic cylinder barrel is coupled with the floating body.

19. The cutting dredger according to claim 8, wherein a line of action of the hydraulic cylinder extends at between about 10° to about 50° with respect to the horizontal during moving of the elongate cutter ladder between the upwards position and the cutting position.

20. The cutting dredger according to claim 8, comprising a spud device for providing support to the cutting dredger during dredging operations.

21. The cutting dredger according to claim 8, wherein the length of the cutter ladder is between 10 and 70 meters.

22. The cutting dredger according to claim 8, wherein the hydraulic cylinder is hingeably coupled to the elongate cutter ladder at a second hinge point, and the second hinge point in in a line substantially vertical with the hinge point when the elongate cutter ladder in in an upwards position.

* * * * *